United States Patent [19]

Schantz

[11] 4,228,415

[45] Oct. 14, 1980

[54] COMPACT SOLENOID WITH PIN TERMINALS

[76] Inventor: Spencer C. Schantz, 5880 Anchorage Rd., Oconomowoc, Wis. 53066

[21] Appl. No.: 928,208

[22] Filed: Jul. 26, 1978

[51] Int. Cl.[3] ..... H01F 7/10

[52] U.S. Cl. ..... 335/255; 335/245; 336/198

[58] Field of Search ..... 335/245, 255, 256, 251, 335/250, 281, 282; 336/198

[56] References Cited

U.S. PATENT DOCUMENTS

| | | | |
|---|---|---|---|
| 2,111,232 | 3/1938 | Wetzel | 335/245 |
| 2,909,713 | 10/1959 | Hambor et al. | 335/255 |
| 2,987,655 | 6/1961 | McCurdy | 335/256 |
| 3,283,275 | 11/1966 | Rider, Jr. | 335/245 |
| 3,546,647 | 12/1970 | Roddy et al. | 336/198 |

FOREIGN PATENT DOCUMENTS

| | | | |
|---|---|---|---|
| 1094881 | 12/1960 | Fed. Rep. of Germany | 335/245 |

*Primary Examiner*—Harold Broome
*Attorney, Agent, or Firm*—Henry C. Fuller

[57] ABSTRACT

Disclosed herein is an inexpensive tubular electromagnetic solenoid which employs stamped and drawn parts with a minimum of machined parts. The tubular housing is deep drawn and has a relatively light gauge side wall and an integrally formed end wall with apertures for pin terminals. A stamped flux enhancing disc is anchored exteriorly of the end wall and is swaged to a projecting portion of a pole piece located interiorly of the end wall. The flux disc-pole piece assembly rigidifies the housing end wall and the pole piece supports and positions one end of the bobbin. Stamped washers having axial apertures interfit into the end of the tubular housing and receive and support the other end of the bobbin. The bobbin has integrally molded pin terminal support bosses which project through apertures in the end wall and position and support the terminations.

13 Claims, 7 Drawing Figures

102
100
106
108
22
20
24
10
12
18
14
16
32
34
26
30
132
86
92
88
90
135
42
40
48
44
135
80
80
56
46
70
68
50
72
72
64
66

COMPACT SOLENOID WITH PIN TERMINALS

BACKGROUND OF INVENTION

Prior tubular solenoids typically include a cylindrical housing surrounding a coil with precision machined end pieces closing the housing at opposite ends of the bobbin. The housing ends are typically crimped over the end pieces. The tolerances of the inside diameter of the housing and the outside diameters of the machined end pieces are very critical. Moreover, the prior art tubular solenoids require extensive tape wrapping and insulation to finish the solenoids. The leads emerge either from slots inside of the tube or grooves milled in the machine pole pieces. Considerable labor is required to machine and assemble the parts of the prior art solenoids referred to.

SUMMARY OF INVENTION

The invention provides a low cost tubular solenoid in which the use of machined parts is kept to a minimum. Only a pole piece and the plunger are machined. A simple deep drawn tubular can or housing with an integrally formed end wall houses the parts. A pole piece or back stop located inside the housing end wall is swaged to a stamped flux disc located on the outside of the end wall to secure the pole piece to the housing, increase the rigidity of the parts and enhance the magnetic flux concentration at the end of the solenoid.

The bobbin is anchored at the other end of the tubular container by one or more stamped washers which have a central aperture which receives the end of the bobbin and occupies the space between the bobbin and the inside surface of the tubular wall to positively position that end of the bobbin. The washers concentrate the magnetic flux at the open end of the bobbin.

Other features of the invention include a bobbin having three spaced flanges with a space between the first two flanges adapted to contain the coil and a space between the second and third flanges providing a work zone for anchoring pin terminals or making connection of the magnet wire with lead wires. Insulation of the coil from the housing is afforded by a sleeve formed from a sheet of a polymer insulator such as KAPTON, a trade mark of duPont. The sleeve is dropped into the housing before installation of the bobbin.

Further objects, advantages and features of the invention will become apparent from the disclosure.

DESCRIPTION OF THE PREFERRED EMBODIMENT

Although the disclosure hereof is detailed and exact to enable those skilled in the art to practice the invention, the physical embodiments herein disclosed merely exemplify the invention which may be embodied in other specific structure. The scope of the invention is defined in the claims appended hereto.

Figure 1:
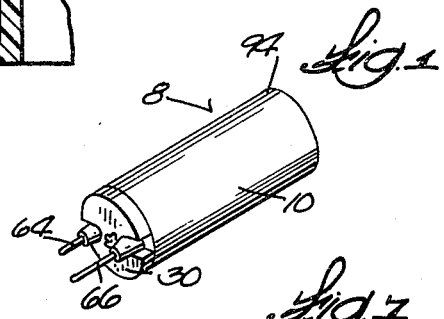
FIG. 1 is a perspective view of an electromagnetic solenoid in accordance with the invention.
Figure 6:
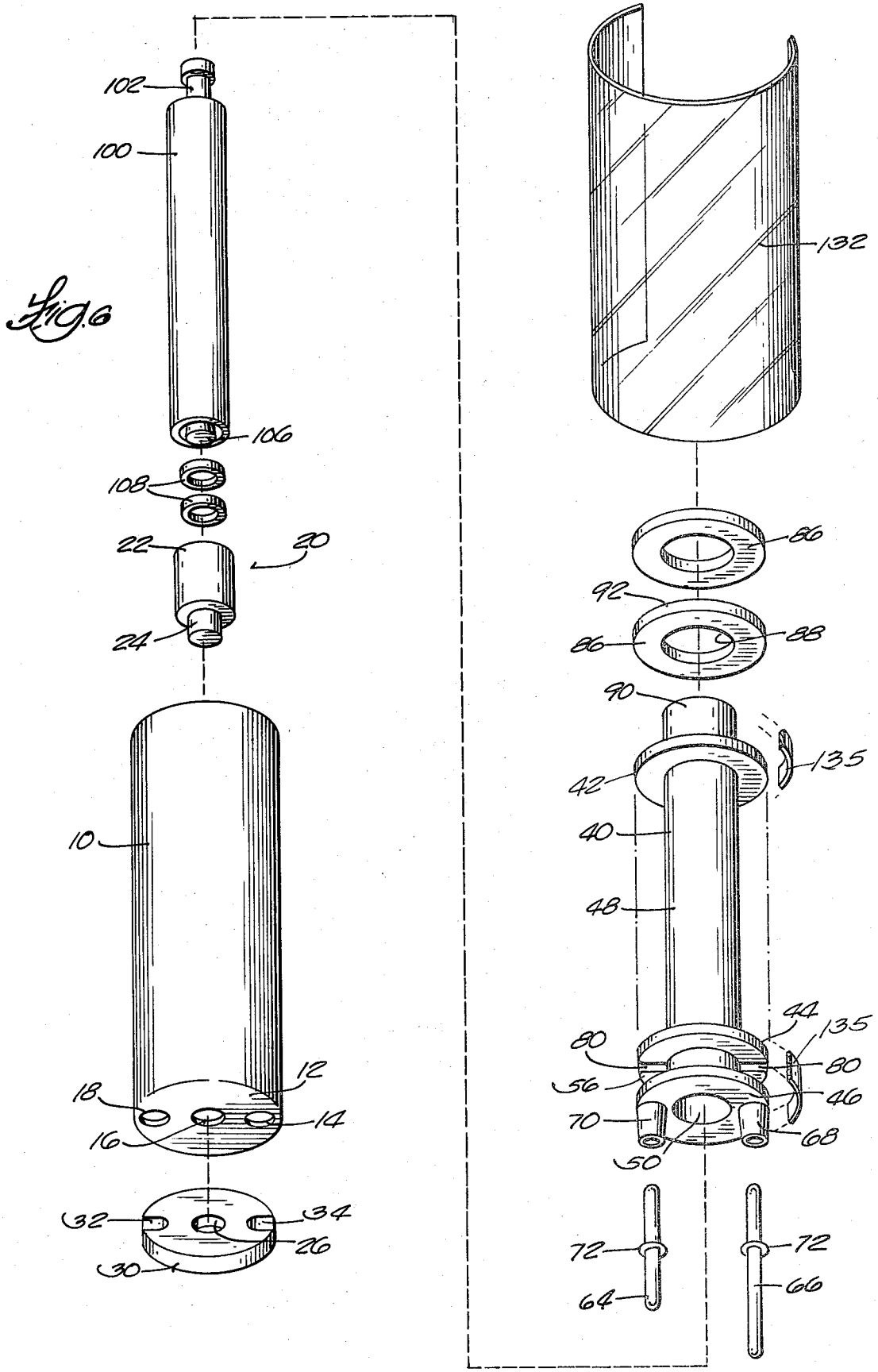
FIG. 6 is an exploded view showing assembly of the parts of the solenoid shown in FIG. 2.

FIG. 1 shows a solenoid 8 which includes a tubular housing 10 having a relatively thin wall with an integrally formed end wall 12 (FIG. 6) with a series of diametrally aligned apertures 14, 16 and 18. The tubular housing 10 is desirably a simple deep drawn can which is relatively inexpensive to manufacture.

To increase the magnetic pull at the closed end of the solenoid 8, a machined pole piece 20 is provided (FIGS. 2, 6) which has a first portion 22 and a reduced diameter portion 24. The pole piece 20 is secured to the housing 10 by connection of portion 24 to flux disc 30. The end 31 of portion 24 is staked to secure the pole piece 20 to the end wall 12 and disc 30. The flux disc 30 in assembly with the pole piece 20 and end wall 12 provides a rigid support for the pole piece 20. The flux disc 30 adds effective thickness to the end wall 12, thereby adding magnetic flux conducting capacity adjacent the pole piece 20. The flux disc 30 is also provided with peripheral slots 32 and 34 which register with apertures 14 and 18 to receive the pin terminals of the bobbin as presently described.

Figure 2:
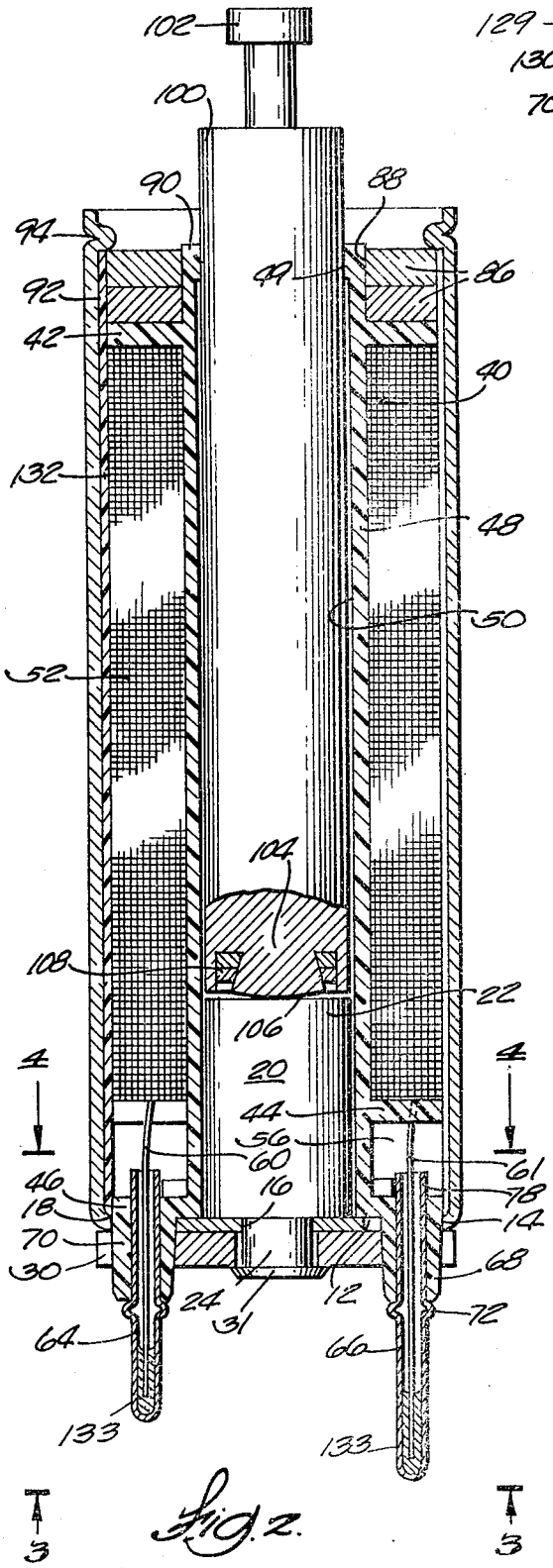
FIG. 2 is a greatly enlarged sectional view of the solenoid shown in FIG. 1.

The bobbin 40 has integrally molded first, second and third flanges 42, 44 and 46 which extend radially from a central sleeve portion 48 having a bore 50. The wire coil 52 is contained between flanges 42 and 44. The annular space or zone 56 between flanges 44 and 46 provides an area for handling the magnet wire leads 60, 61 (FIG. 2).

Figure 5:
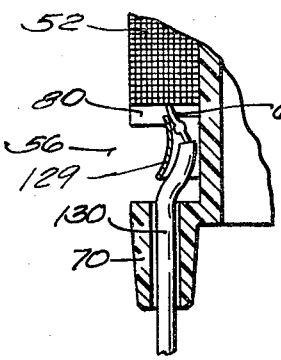
FIG. 5 is a modified embodiment of the solenoid employing lead wire connections rather than pin terminals.

In the embodiment shown in all figures except FIG. 5, pin terminals 64 and 66 are employed for electrically connecting the magnet wire to a power source. The pin terminals are supported in integrally molded apertured bosses 68 and 70. The pin terminals 64, 66 are provided with ribs 72 which limit penetration of the terminals 64 and 66 through flange 46 so that the projecting ends 78 of the terminals can be suitably staked by tools which enter through slots 80 in flange 44. To prevent breaking of the coil wires caused by rotation of the pins 64 and 66, pads 82 are provided which are integrally molded into the bobbin and prevent rotation of the staked ends of the terminals. The pads are separated by slots 83 which facilitate entry of the staking or swaging tool. The magnet wire leads 60 and 61 are soldered in the hollow terminals 64, 66 by dipping the terminals in a solder pot, causing solder 133 to wick into terminals 64 and 66.

The open end of the bobbin is supported in the tubular housing 10 by one or more stamped ferromagnetic washers 86 which have a central aperture 88 sized to receive the end 90 of the bobbin and which have a peripheral surface 92 sized to interfit within the inside surface of the tubular container 10. The washers 86 can be anchored in place by dimples 94 spaced along the tubular housing which confine the washers 86 against the flange 42 on the bobbin 40. The stamped ferromagnetic washers are less expensive to manufacture than the machined end pieces typically employed in tubular solenoids and one or more can be employed to provide the desired magnetic flux concentration.

The plunger 100 is machined and is provided with a coupling member 102 and a shading ring post 104 surrounded by an annular space. The post 104 is tapered inwardly or undercut as illustrated in FIG. 2. Shading rings 108 are placed around the post 104 and swaged into the undercut or taper on post 104 and hence securely held in place.

The end of post 104 is machined with a spherical radius 106 approximately equal to the length of the plunger 100 that is within the bobbin when it is fully inserted in the bobbin bore. The radius of end 106 cooperates with the reduced bobbin bore 49 located at the open end of the bobbin to minimize buzz and hum when operated on alternating current. Reduced bore 49 is located at the end of the bore to provide a maximum dimension to radius 106, be clear of mold shrinkage from flange 42 and avoid circumferential compression from the magnet wire.

FIG. 5 illustrates a bobbin with lead wires 130 employed for connection to the magnet wire rather than the use of pin terminals. In this case, the zone 56 provides a space for soldering and connection of the magnet wires to the lead wires 130 and bosses 68 and 70 provide insulated bushings for lead wires 130 through can end 12 and plate 30. Insulation and lead retention is provided by turns of tape 129.

In assembly, an insulating sleeve 132 formed from high temperature material such as KAPTON is formed into a tube and inserted into the interior of the tubular housing 10 and the bobbin is then positioned in place. Dielectric strength of sleeve 132 can be increased by the addition of tape turns 135 to bobbin flanges 42 and 46 to increase the length of the insulation from the inside of the flange along the inside (sticky side) of tape 135 and thence along the interface of the outside of tape 135 and the inside of sleeve 132 to housing 10. The washers 86 are anchored in place by the dimples.

Figure 7:
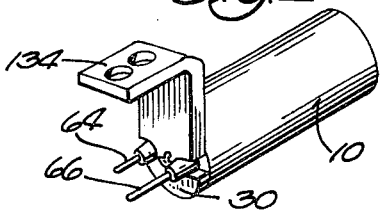
FIG. 7 is a perspective view of a modified embodiment of the invention.
Figure 4:
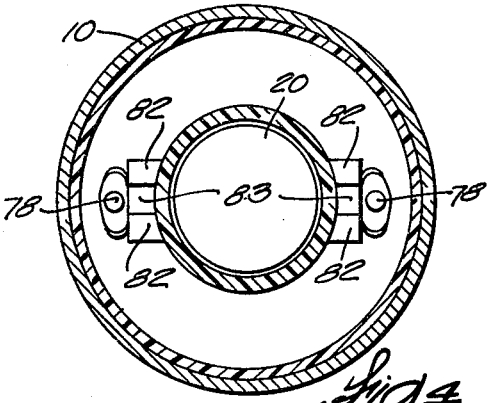
FIG. 4 is a view taken along line 4—4 of FIG. 2.
Figure 3:
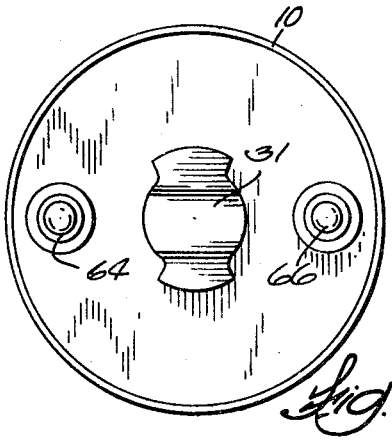
FIG. 3 is an end view of the solenoid shown in FIG. 2 viewed along line 3—3.

The solenoid of the invention employs a relatively thin walled housing which substantially reduces weight and cost. The separable flux disc used to add magnetic flux conducting capacity also adds structural rigidity to the assembly of parts and compensates for the structural deficiencies of the thin walled housing. At least one design of flux disc can be in the form of a mounting bracket 134 as illustrated in FIG. 7. The thickness of the flux disc is selected with reference to the combined thickness of housing end 12 so that the flux disc 30 is not the weakest link in the flux path.

What is claimed is:

1. In a tubular electromagnetic solenoid having a bobbin, a coil wound on the bobbin, a bore in said bobbin, and a ferromagnetic plunger axially movable within said bore, the improvement comprising a tubular deep drawn ferromagnetic housing for said bobbin and coil, said housing being relatively thin walled and having an integrally formed end wall, a ferromagnetic pole piece having a first portion sized to fit within said bore and a second mounting portion, a first ferromagnetic flux disc to add effective flux carrying thickness to said housing end wall, and means for securing said second pole piece portion to said flux disc, with said end wall located therebetween.

2. The improvement of claim 1 wherein said tubular housing end wall has a plurality of apertures, with one of said apertures being located at the center thereof along the longitudinal axis of said tubular housing, and said flux disc having a central aperture registrable with said axial aperture in said end wall to receive the mounting portion of said pole piece, and said pole piece having an end deformed to secure said pole piece, end wall and flux plate in assembly.

3. The improvement of claim 1 wherein said bobbin has end flanges and said coil and said terminations within said housing are insulated from said housing with a sleeve of insulating material, and relatively narrow tape members applied to said end flanges of said bobbin.

4. The improvement of claim 2 wherein said flux disc is stamped and includes a slot registrable with an aperture in said end wall.

5. The improvement of claim 1 including a second stamped ferromagnetic flux disc having a concentric aperture for receiving and supporting one end of said bobbin and sized to interfit within said tubular housing, and means to secure said second flux disc within said housing adjacent the end of said housing remote from said first flux disc.

6. The improvement of claim 5 wherein said second stamped ferromagnetic flux disc is a plurality of stampings, thereby increasing effective thickness.

7. The improvement of claim 5 wherein said means to secure said second flux disc in said tubular housing comprises protrusions in said housing projecting inwardly to hold said second flux disc against said bobbin.

8. In a solenoid having a coil, a bobbin for supporting said coil, said bobbin having a bore and having a ferromagnetic plunger axially movable within said bore, the improvement wherein said bobbin comprises a central sleeve portion with integrally spaced first and second flanges to confine the coil, and a third flange integrally formed with said sleeve portion and spaced from said second flange to provide a magnet wire connection zone, and wherein said third flange includes integrally formed pin terminal support bosses having axial apertures, pin terminals located in said apertures, and deformed areas on the ends of said terminals within said zone to anchor said terminals to said bobbin, and said solenoid including a metallic housing with an end wall having apertures receiving said bosses which project therethrough and isolate and insulate said pin terminals from the housing end wall.

9. The improvement of claim 8 wherein said third flange includes integrally formed lead wire insulating bushings having axial apertures.

10. In a solenoid having a coil, a bobbin for supporting said coil, said bobbin having a bore and having a ferromagnetic plunger axially movable within said bore, the improvement wherein said bobbin comprises a central sleeve portion with integrally spaced first and second flanges to confine the coil, and a third flange integrally formed with said sleeve portion and spaced from said second flange to provide a magnet wire connection zone, said third flange including integrally formed pin terminal support bosses having axial apertures, pin terminals located in said apertures, and deformed areas on the ends of said terminals within said zone to anchor said terminals to said bobbin, and including axial protrusions on the inside face of said third flange and located relative to said terminal deformed areas to interfere with rotation of said terminals.

11. The improvement of claim 10 including access slots in said second flange opposite said terminal apertures in said third flange to afford access of deforming tools and egress of magnet wire from the winding area to the terminating area.

12. In a tubular electromagnetic solenoid having a bobbin, a coil wound on the bobbin, a bore in said bobbin and a ferromagnetic plunger, the improvement comprising a thin walled, light weight ferromagnetic housing having an apertured end wall, stamped ferromagnetic flux discs at opposite ends of said housing, pin terminal bosses on said bobbin projecting through said apertures in said end wall and one of said flux discs to support and position one end of said bobbin, and the other of said flux discs interfitting with said bobbin and housing to support the other end of said bobbin and enclose the end of the housing opposite said end wall.

13. The improvement of claim 12 wherein one of said flux discs has a bracket mounting portion.

* * * * *